US010376064B1

(12) United States Patent
Lai et al.

(10) Patent No.: US 10,376,064 B1
(45) Date of Patent: Aug. 13, 2019

(54) ADJUSTABLE LIFTING STRUCTURE FOR CHAIR BACK

(71) Applicants: Yen-Chuan Lai, Taibao (TW); Yen-Ji Lai, Taibao (TW)

(72) Inventors: Yen-Chuan Lai, Taibao (TW); Yen-Ji Lai, Taibao (TW)

( * ) Notice: Subject to any disclaimer, the term of this patent is extended or adjusted under 35 U.S.C. 154(b) by 0 days.

(21) Appl. No.: 15/939,407

(22) Filed: Mar. 29, 2018

(51) Int. Cl.
*A47C 7/40* (2006.01)

(52) U.S. Cl.
CPC ..... *A47C 7/402* (2013.01)

(58) Field of Classification Search
None
See application file for complete search history.

(56) References Cited

U.S. PATENT DOCUMENTS 5,286,088 A * 2/1994 Taylor ..... A47C 1/03255 297/300.1
5,324,096 A * 6/1994 Schultz ..... A47C 1/03 297/353
6,299,253 B1 * 10/2001 Chen ..... A47C 7/402 297/353
6,709,059 B1 * 3/2004 Cvek ..... A47C 7/402 297/353
7,360,837 B1 * 4/2008 Liu ..... A47C 7/402 297/353
2016/0206104 A1 * 7/2016 Cybulski ..... A47C 1/03

* cited by examiner

*Primary Examiner* — David E Allred
(74) *Attorney, Agent, or Firm* — Alan D. Kamrath; Mayer & Williams PC

(57) ABSTRACT

An adjustable lifting structure for a chair back contains: a first adjustment unit and a second adjustment unit. The first adjustment unit mates with the second adjustment unit via a transmission cable, and the first adjustment unit includes a longitudinally hollow chamber for slidably accommodating a guide plate connected on a seat. The first adjustment unit includes a body and two covering assemblies. A drive block includes a locking space, a slit, two deformable chambers, a trough, and two projections. The guide plate includes a conducting element and a rail having multiple teeth and multiple cutouts. The second adjustment unit includes an adjuster, an operation cavity, a first aperture, a connecting room, and two stop segments. A transmission cable includes a first transmitting segment and a second transmitting segment, wherein the first transmitting segment has a first defining portion, and the second transmitting segment has a second defining portion.

2 Claims, 15 Drawing Sheets

ADJUSTABLE LIFTING STRUCTURE FOR CHAIR BACK

BACKGROUND OF THE INVENTION

Field of the Invention

The present invention relates to an adjustable lifting structure for a chair back.

Description of the Prior Art

A conventional adjustable lifting mechanism for a chair contains a chair frame erected on a ground, a seat fixed on a top of the chair frame, a support column connected on a bottom of a rear end of the seat and extending upwardly, a body movably fixed on an upper end of the support column, and a chair back connected with the body. The support column includes multiple locking orifices defined on the upper end of the support column. The adjustable lifting mechanism includes a case facing and integrally connected with the chair back, and the case has an accommodation space defined therein and fitting on the upper end of the support column; a lever rotatably connected on a rear surface of the case, wherein a first end of the lever has a retainer flexibly rotating and inserting to the case so as to retain in one of the multiple locking orifices, and a protrusion is arranged on a second end of the lever and is pressed to drive the retainer to remove from the one of the multiple locking orifices.

However, the conventional adjustable lifting mechanism is complicated, and the case is produced and is fixed on the chair back by using screwing elements. Furthermore, a movement of the chair back is limited because of a number of the multiple locking orifices, hence a lifting height is adjusted in limited adjustment section, continuously variable adjustment of the chair back is impossible.

The present invention has arisen to mitigate and/or obviate the afore-described disadvantages.

SUMMARY OF THE INVENTION

The primary objective of the present invention is to provide an adjustable lifting structure for a chair back which adjustably lifts and fixes the chair back and a seat by ways of a guide plate.

To obtain above-mentioned objective, an adjustable lifting structure for a chair back provided by the present invention contains: a first adjustment unit and a second adjustment unit.

The first adjustment unit mates with the second adjustment unit via a transmission cable, and the first adjustment unit includes a longitudinally hollow chamber formed therein vertically and configured to slidably accommodate a guide plate, and a bottom of the guide plate is connected on a seat, the first adjustment unit is disposed on a rear surface of the chair back, and the second adjustment unit is fixed on the rear surface of the chair back. The first adjustment unit includes a body, two covering assemblies connected on a front end and a rear end of the body respectively so that the longitudinally hollow chamber is defined among the body and the two covering assemblies, the body has a protrusion arranged on the front end of the body, a receiving groove formed in the protrusion and having a guiding recess defined on a first end of the receiving groove, a limiting segment arranged on a second end of the receiving groove, a slide recess extending from a center of the limiting segment, two flexible spaces formed on two side of the slide recess individually, a first conduct recess defined on a distal end of the slide recess, and a second conduct recess extending from an end of the first conduct recess. The body further includes multiple first connection portions and a first coupling orifice which are formed on two sides of the body respectively, wherein the multiple first connection portions and the first coupling orifice are configured to connect with each of the two covering assemblies, and the body includes multiple second coupling orifices defined thereof and configured to fix the body on the chair back. The body includes a first trench defined on the rear end thereof and includes a second trench longitudinally formed on the body, wherein the first trench has an engagement element mounted thereof adjacent to a top of the first trench, and the engagement element has a screwing portion defined on an end thereof so as to screw on the body. A drive block includes a locking space defined on a front surface thereof, a slit extending from an end of the locking space, two deformable chambers defined on two sides of the locking space respectively, a driving segment formed on a first end of the drive block, a retainer formed on a rear surface of the drive block, a trough defined on a center of a side of the retainer, and two projections formed on two sides of the trough respectively. The retainer is accommodated in the receiving groove of the body so that the locking space and the two deformable chambers are defined outwardly, the retainer is formed inwardly, and the trough and the two projections correspond to the second trench of the body. The guide plate includes a conducting element arranged on a surface thereof and includes a rail defined on a side of the conducting element so that after the guide plate is slidably accommodated in the first trench of the body, the rail is slidably housed in the second trench. The rail has multiple teeth and multiple cutouts which are connected together, and each of the multiple teeth is defined between any two adjacent of the multiple cutouts, such that the multiple teeth and the multiple cutouts individually correspond to and retain with the two projections and the trough of the drive block. The conducting element has a channel longitudinally formed thereof and configure to slidably house the engagement element of the body, wherein the channel has two raised portions extending inwardly and located adjacent to a top of the channel so as to abut against two sides of the engagement element respectively. The second adjustment unit includes an adjuster, an operation cavity defined in the adjuster, a first aperture formed on a first end of the operation cavity, a connecting room formed on a second end of the operation cavity, two stop segments formed on two distal ends of two sides of the connecting room individually. The adjuster further has a second aperture defined on a first side thereof, an indentation arranged on a second side of the adjuster opposite to the first side of the adjuster, a third aperture defined on the adjuster such that a fixing element inserts through the third aperture so as to connect with a second connection portion of an adjustment cover which is coupled on the adjuster. The adjuster has multiple fourth apertures formed thereof respectively, the adjustment cover has multiple affix portions corresponding to the multiple fourth apertures, multiple lock elements connected on the chair back via the multiple affix portions and the multiple fourth apertures individually. An actuation unit is slidably housed in the operation cavity of the adjuster, wherein the actuation unit includes an actuating element, two resilient elements, a band, and a pull ring, wherein the actuating element has a recessed segment defined on a first end thereof and slidably limited by two stop segments of the adjuster, two positioning columns respectively extending from two sides of the recessed segment and configured to fit with the two resilient elements respectively, hence the two resilient elements are accommodated in the connecting room of the adjuster. The actuating element has a notch corresponding to the second aperture and the indentation of the adjuster, and a fifth aperture defined on a second end of the actuating element. The band has a third connection portion corresponding to the actuating element, a joining element arranged on the third connection portion and connected with a first end of the band, and the pull ring is connected with a second end of the band, hence the pull ring is pulled to drive the band, and the band actuates the joining element to drive the actuating element to move. A transmission cable includes a first transmitting segment and a second transmitting segment which are defined on two ends of the transmission cable respectively, wherein the first transmitting segment has a first defining portion formed on a distal end thereof, and the second transmitting segment has a second defining portion defined on a distal end thereof, wherein the first transmitting segment is fixed in the second aperture of the adjuster, the notch of the actuating element, and a dent of the adjuster so that the first defining portion of the distal end of the first transmitting segment is limited in the indentation of the adjuster. The second transmitting segment is fixed in the second conduct recess and the first conduct recess of the body and the slit of the drive block so that the second defining portion of the distal end of the second transmitting segment is limited in the locking space of the drive block.

As desiring to lift the chair back, the pull ring of the second adjustment unit is pulled so that the notch of the actuating element pulls the first transmitting segment of the transmission cable, and the drive block of the first adjustment unit is pulled by the second transmitting segment so that the trough and the two projections of the drive block remove from the multiple teeth and the multiple cutouts of the rail individually, and user manually pulls the chair back to move longitudinally relative to the guide plate. After adjusting the chair back to a desired position, the pull ring is released so that the two resilient elements push the actuating element to move back to an original position, and the drive bock is pushed by the two resilient elements to urge the trough and the two projections to engage with the multiple teeth and the multiple cutouts respectively, and the chair back, the seat and the guide plate are positioned, thus adjustably lifting the chair back.

As desiring to remove the guide plate from the longitudinally hollow chamber of the first adjustment unit, the engagement element is pulled upward so as to move across and being against the two raised portions, hence the guide plate removes from the longitudinally hollow chamber of the first adjustment unit so as to store the guide plate and the first adjustment unit.

BRIEF DESCRIPTION OF THE DRAWINGS

FIG. 3-1 is a perspective view showing the assembly of a drive block of the adjustable lifting structure for the chair back according to the preferred embodiment of the present invention.

FIG. 3-2 is another perspective view showing the assembly of the drive block of the adjustable lifting structure for the chair back according to the preferred embodiment of the present invention.

FIG. 3-3 is a perspective view showing the assembly of a part of the adjustable lifting structure for the chair back according to the preferred embodiment of the present invention.

DETAILED DESCRIPTION OF THE PREFERRED EMBODIMENTS

Figure 1:
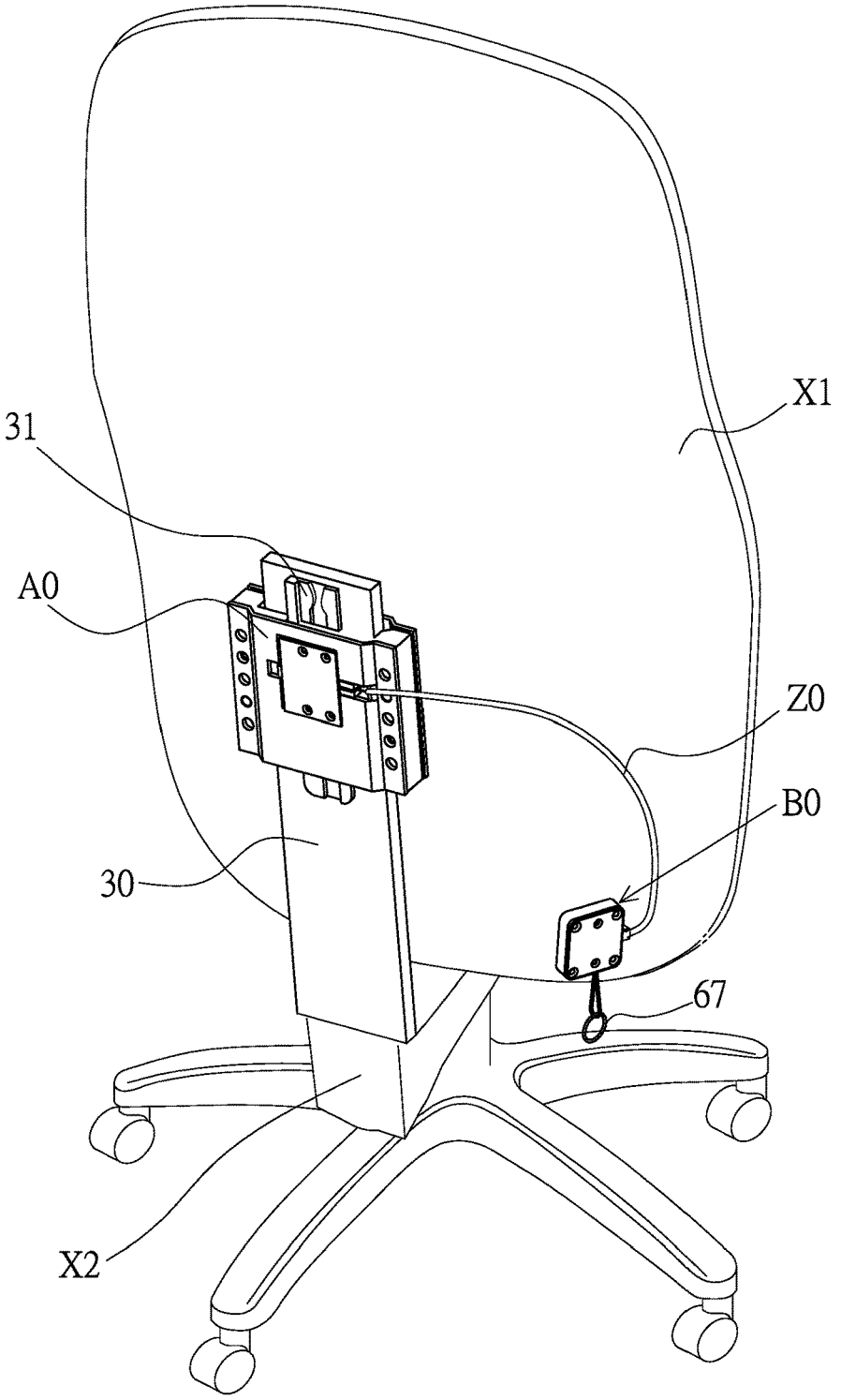
FIG. 1 is a perspective view showing the assembly of an adjustable lifting structure for a chair back according to a preferred embodiment of the present invention.
Figure 2:
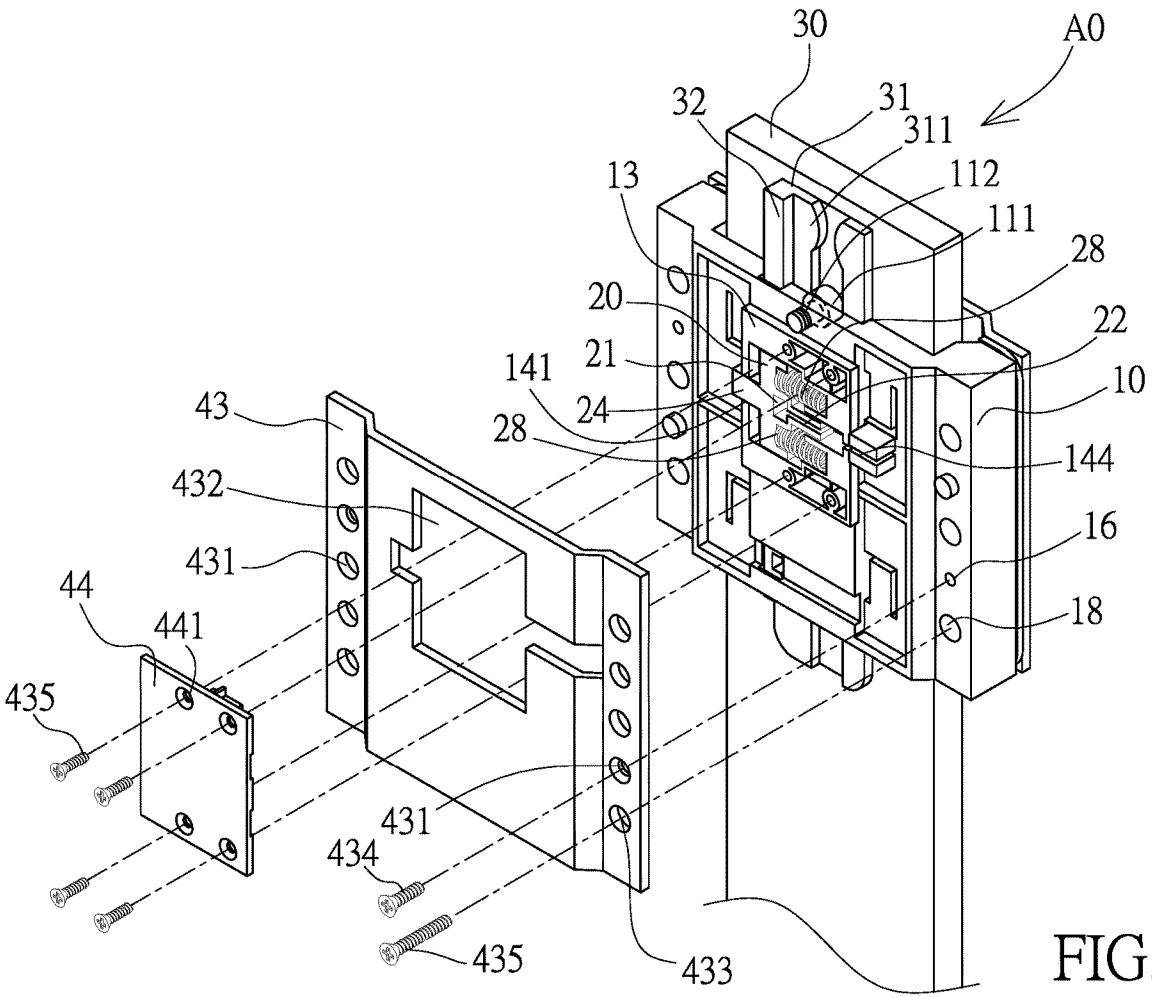
FIG. 2 is a perspective view showing the exploded components of a first adjustment unit of the adjustable lifting structure for the chair back according to the preferred embodiment of the present invention.
Figure 3:
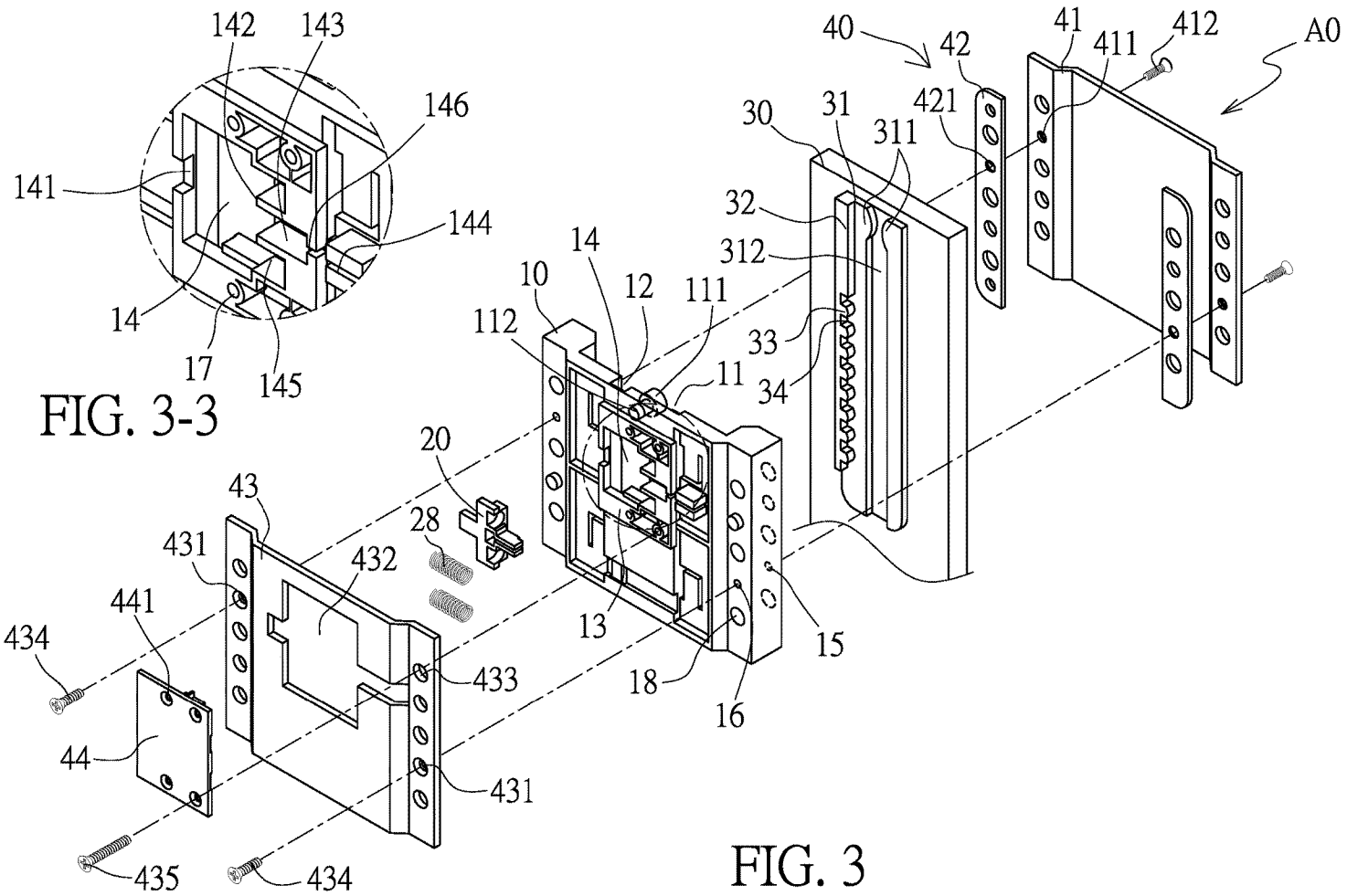
FIG. 3 is another perspective view showing the exploded components of the first adjustment unit of the adjustable lifting structure for the chair back according to the preferred embodiment of the present invention.
Figures 1, 3:
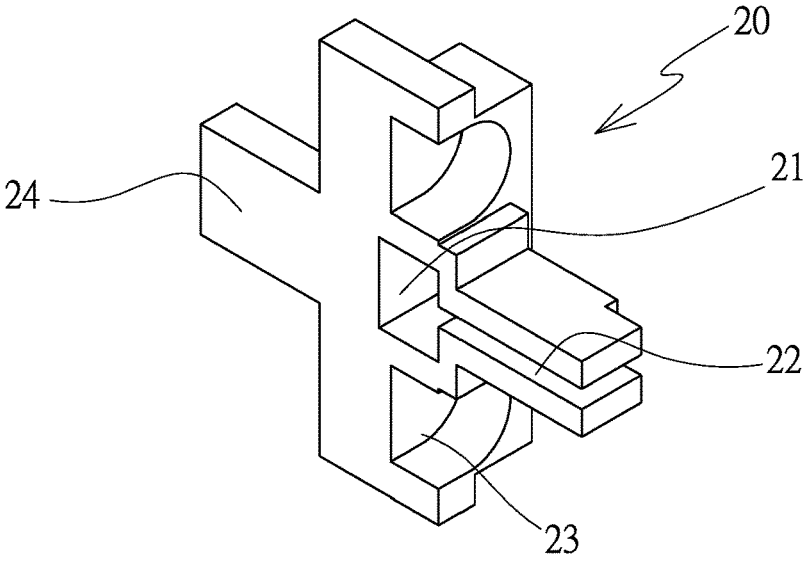
Figures 2, 3:
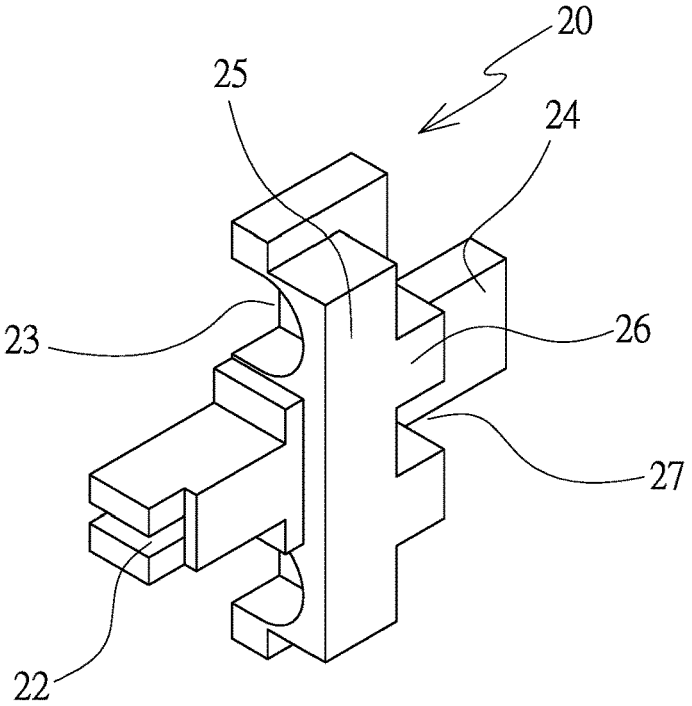
Figure 4:
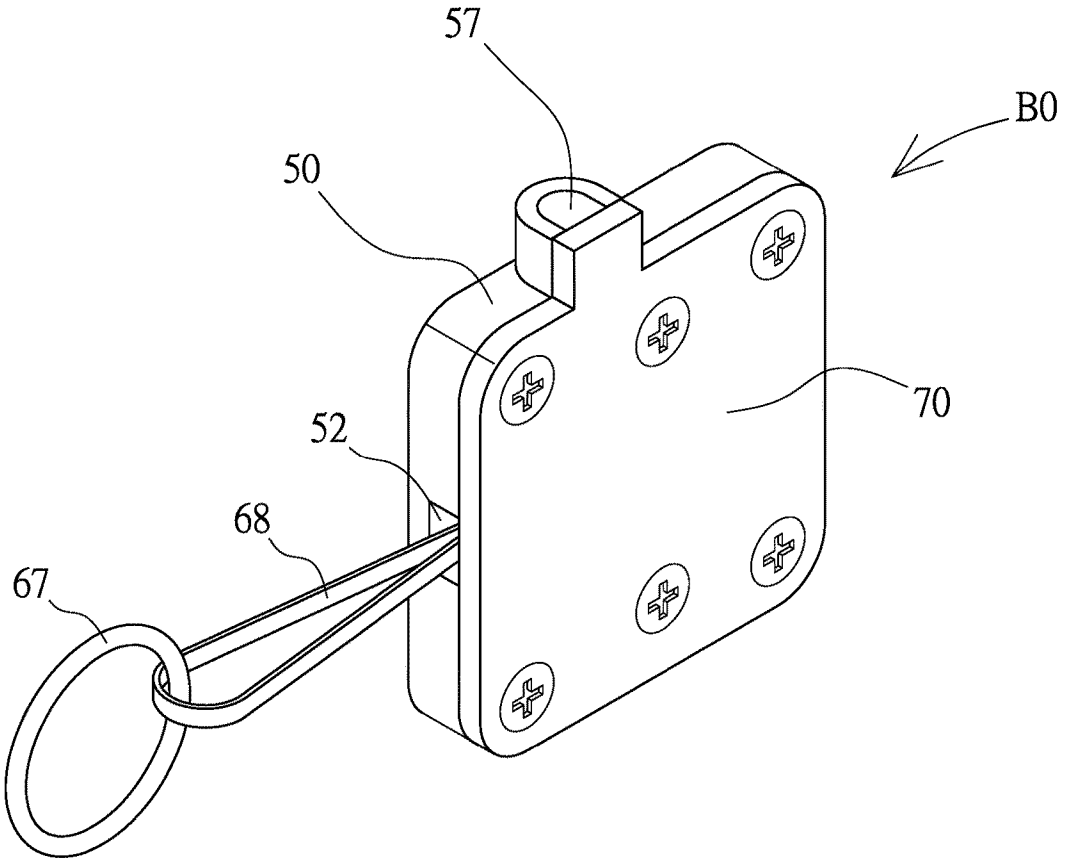
FIG. 4 is a perspective view showing the assembly of a second adjustment unit of the adjustable lifting structure for the chair back according to the preferred embodiment of the present invention.
Figure 5:
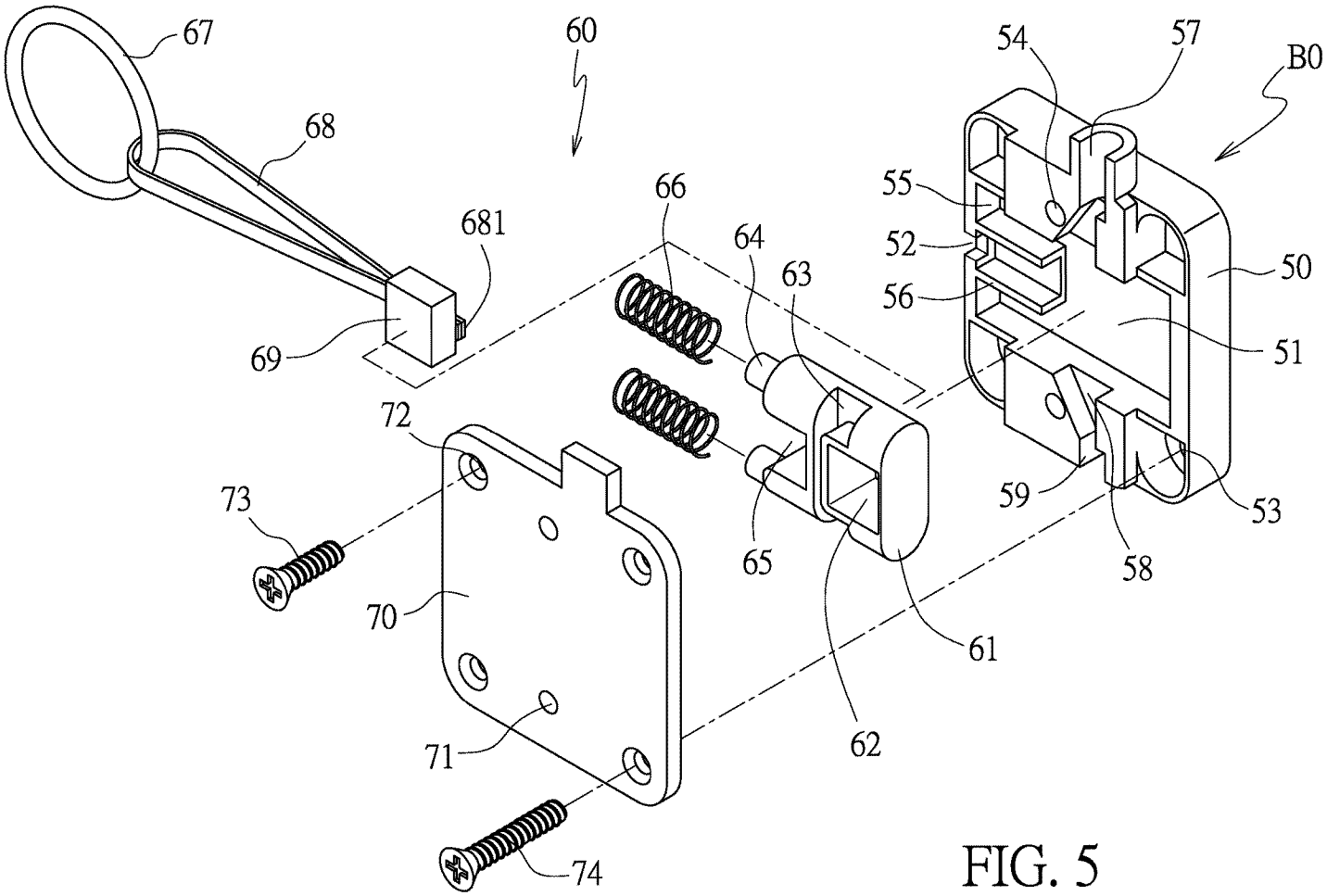
FIG. 5 is a perspective view showing the exploded components of the second adjustment unit of the adjustable lifting structure for the chair back according to the preferred embodiment of the present invention.
Figure 6:
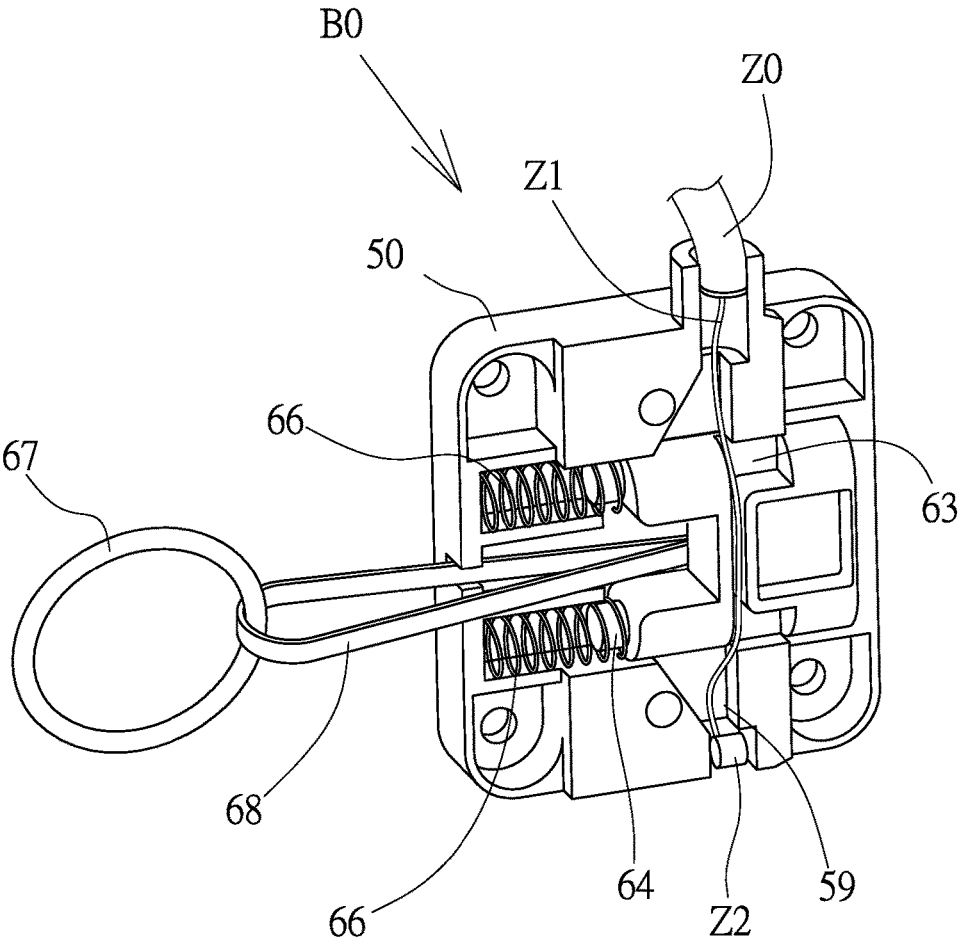
FIG. 6 is a perspective view showing the operation of the second adjustment unit of the adjustable lifting structure for the chair back according to the preferred embodiment of the present invention.
Figure 7:
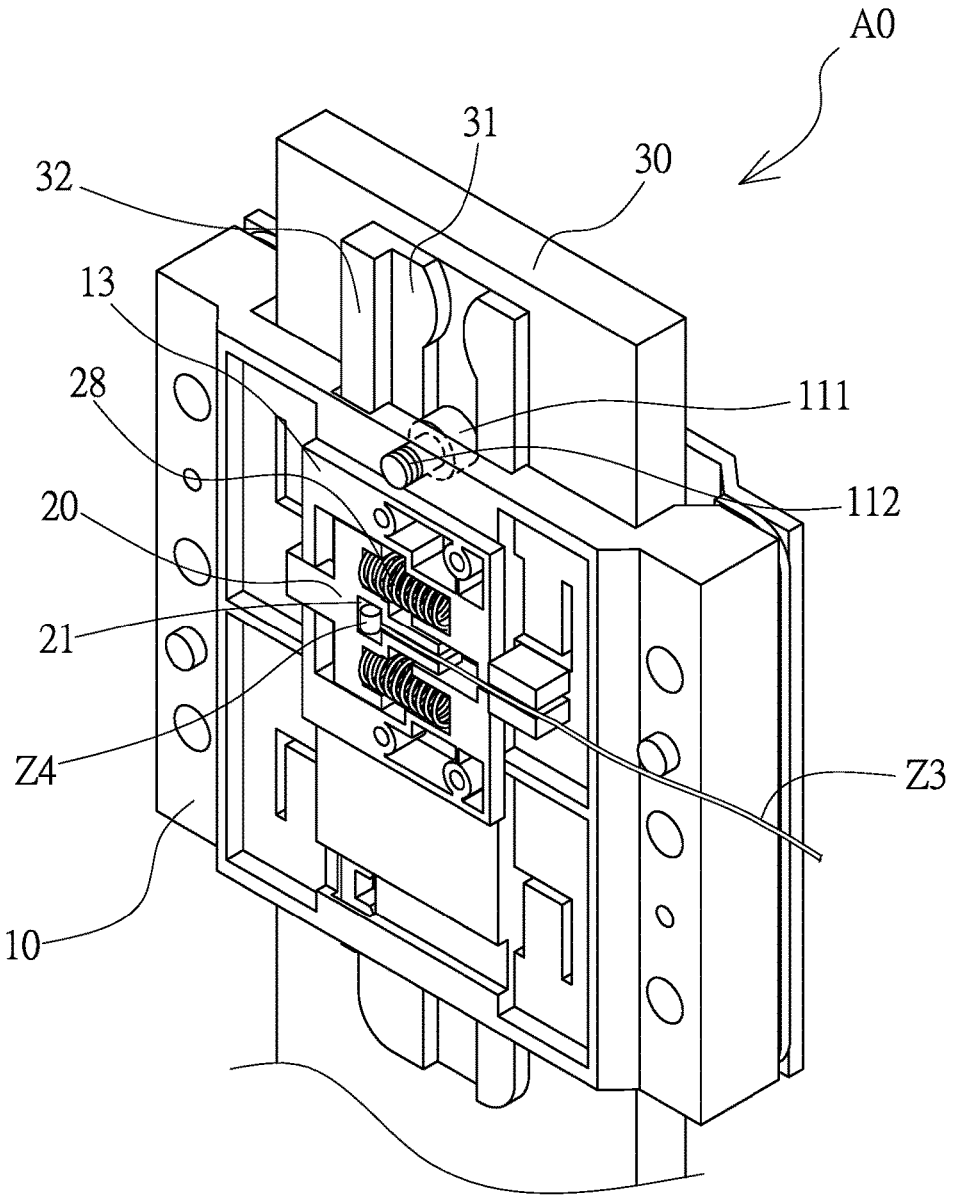
FIG. 7 is a perspective view showing the operation of the first adjustment unit of the adjustable lifting structure for the chair back according to the preferred embodiment of the present invention.
Figure 8:
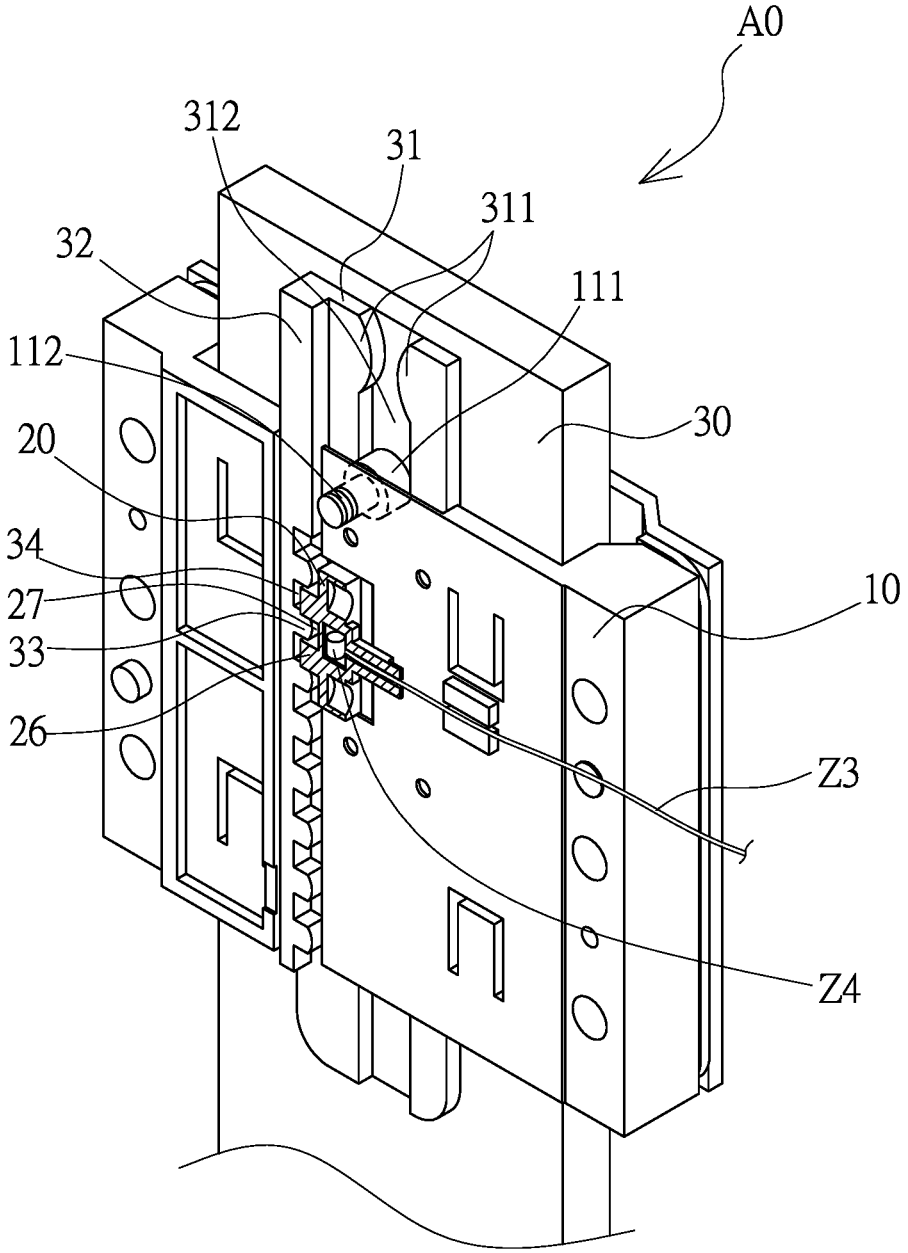
FIG. 8 is another perspective view showing the operation of the first adjustment unit of the adjustable lifting structure for the chair back according to the preferred embodiment of the present invention.
Figure 9:
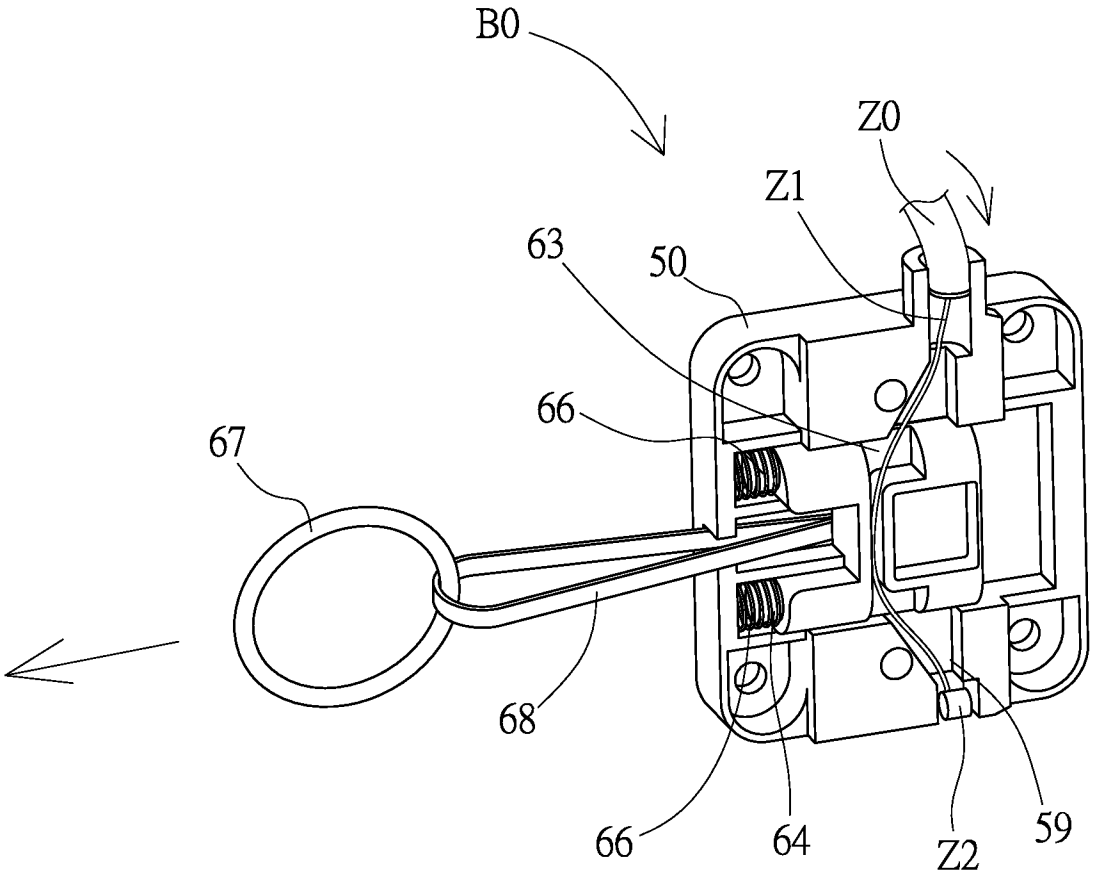
FIG. 9 is another perspective view showing the operation of the second adjustment unit of the adjustable lifting structure for the chair back according to the preferred embodiment of the present invention.
Figure 10:
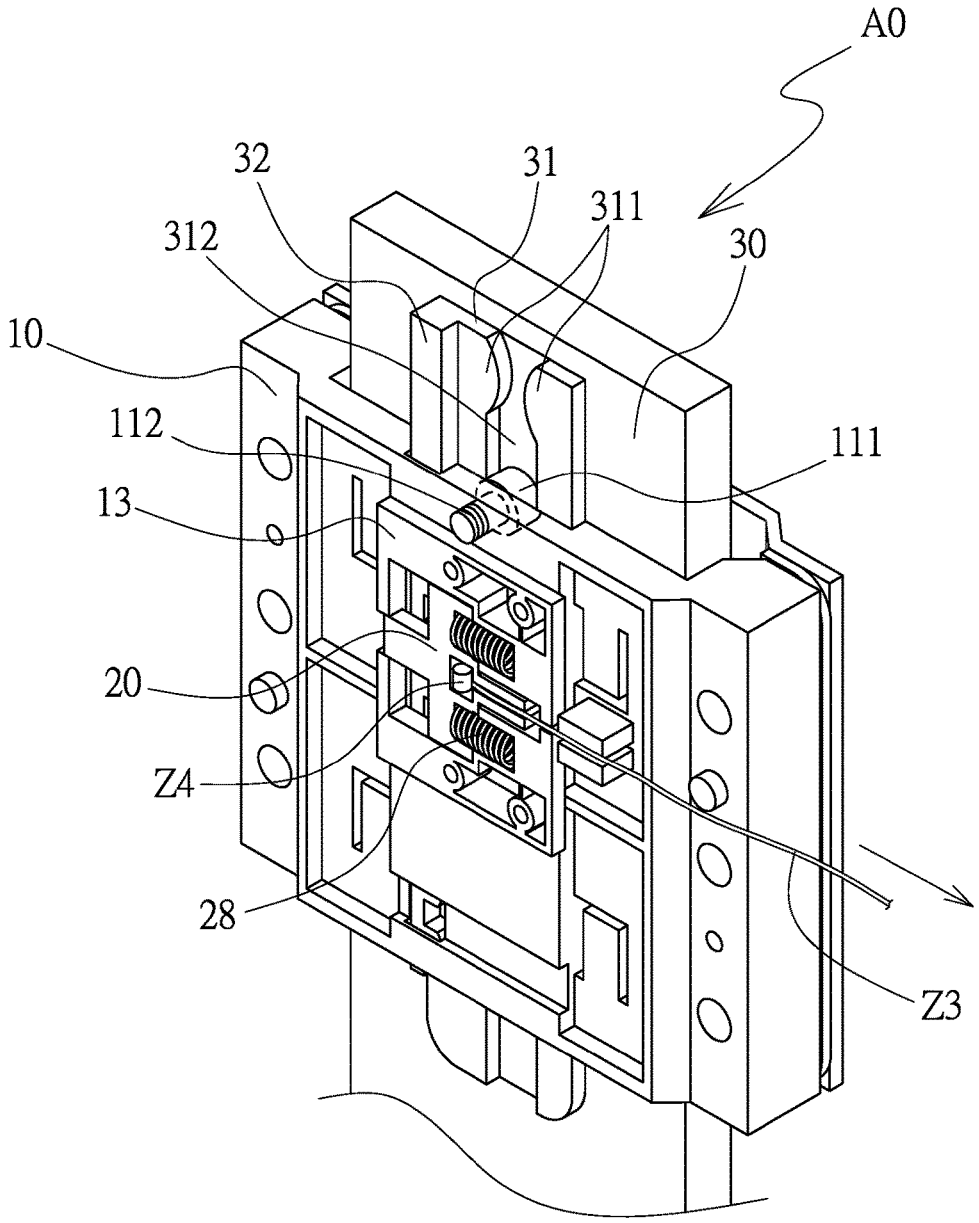
FIG. 10 is also another perspective view showing the operation of the first adjustment unit of the adjustable lifting structure for the chair back according to the preferred embodiment of the present invention.
Figure 11:
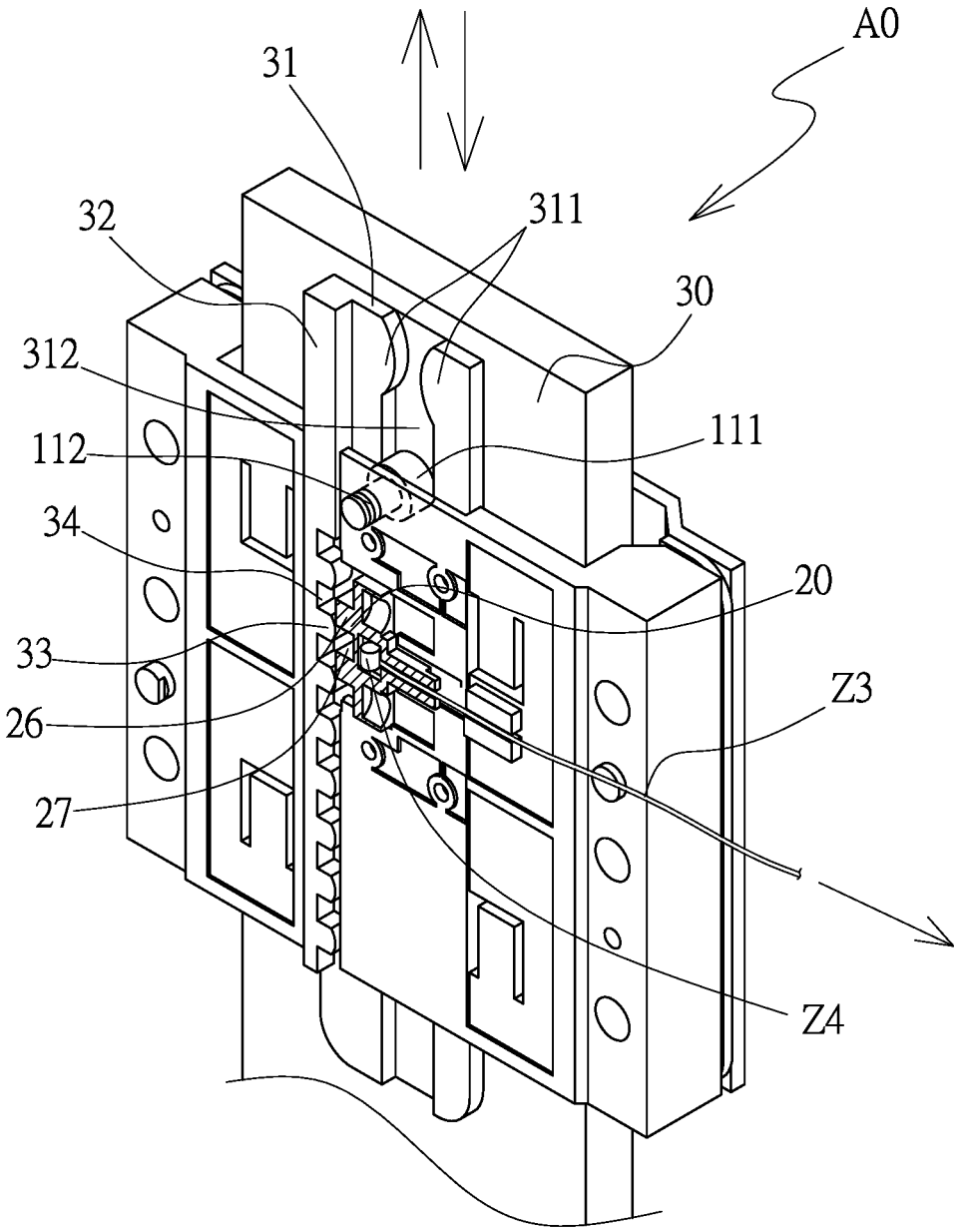
FIG. 11 is still another perspective view showing the operation of the first adjustment unit of the adjustable lifting structure for the chair back according to the preferred embodiment of the present invention.

The present invention will be clearer from the following description when viewed together with the accompanying drawings, which show, for purpose of illustrations only, a preferred embodiment in accordance with the present invention.

With reference to FIGS. 1-5, an adjustable lifting structure for a chair back X1 in accordance with a preferred embodiment of the present invention comprises: a first adjustment unit A0 and a second adjustment unit B0, wherein the first adjustment unit A0 mates with the second adjustment unit B0 via a transmission cable Z0, and the first adjustment unit A0 includes a longitudinally hollow chamber A1 formed therein vertically and configured to slidably accommodate a guide plate 30, and a bottom of the guide plate 30 is connected on a seat X2, the first adjustment unit A0 is disposed on a rear surface of the chair back X1, and the second adjustment unit B0 is fixed on the rear surface of the chair back X1.

The first adjustment unit A0 includes a body 10, two covering assemblies 40 connected on a front end and a rear end of the body 10 respectively so that the longitudinally hollow chamber A1 is defined among the body 10 and the two covering assemblies 40, the body 10 has a protrusion 13 arranged on the front end of the body 10, a receiving groove 14 formed in the protrusion 13 and having a guiding recess 141 defined on a first end of the receiving groove 14, a limiting segment 142 arranged on a second end of the receiving groove 14, a slide recess 143 extending from a center of the limiting segment 142, two flexible spaces 145 formed on two side of the slide recess 143 individually, a first conduct recess 146 defined on a distal end of the slide recess 143, and a second conduct recess 144 extending from an end of the first conduct recess 146.

The body 10 further includes multiple first connection portions 15 and a first coupling orifice 16 which are formed on two sides of the body 10 respectively, wherein the multiple first connection portions 15 and the first coupling orifice 16 are configured to connect with each of the two covering assemblies 40, and the body 10 includes multiple second coupling orifices 18 defined thereof and configured to fix the body 10 on the chair back X1. The body 10 includes a first trench 11 defined on the rear end thereof and includes a second trench 12 longitudinally formed on the body 10, wherein the first trench 11 has an engagement element 111 mounted thereof adjacent to a top of the first trench 11, and the first trench 11 has a screwing portion 112 defined on an end of the engagement element 111 so as to be screwed on the body 10.

Each covering assembly 40 includes a first lid 43, a second lid 41, two washers 42, and a cap 44, wherein the first lid 43 has a first hole 432 corresponding to the protrusion 13 of the body 10, a second hole 431 corresponding to the first coupling orifice 16 of the body 10, and a first screw bolt 434 configured to screw with the second hole 431 and the first coupling orifice 16. The cap 44 has multiple third holes 441 defined thereof respectively, and the body 10 includes multiple third coupling orifices 17 corresponding to the multiple third holes 441 individually, a second screw bolt 435 inserts through each of the multiple third coupling orifices 17 and each of the multiple third holes 441 so as to screw the cap 44 with the protrusion 13. The second lid 41 has multiple fourth holes 411, and the two washers 42 have two fifth holes 421 corresponding to the multiple fourth holes 411 individually, a third screw bolt 412 inserts through each of the two fifth holes 421 and each of the multiple fourth holes 411 so as to screw with each of the multiple first connection portions 15 of the body 10. The body 10 further includes multiple sixth holes 433, each of which screws with the second screw bolt 435 on the chair back X1.

A drive block 20 includes a locking space 21 defined on a front surface thereof, a slit 22 extending from an end of the locking space 21, two deformable chambers 23 defined on two sides of the locking space 21 respectively, a driving segment 24 formed on a first end of the drive block 20, a retainer 25 formed on a rear surface of the drive block 20, a trough 27 defined on a center of a side of the retainer 25, and two projections 26 formed on two sides of the trough 27 respectively; wherein the retainer 25 is accommodated in the receiving groove 14 of the body 10 so that the locking space 21 and the two deformable chambers 23 are defined outwardly, the retainer 25 is formed inwardly, and the trough 27 and the two projections 26 correspond to the second trench 12 of the body 10.

The guide plate 30 includes a conducting element 31 arranged on a surface thereof, a rail 32 defined on a side of the conducting element 31 so that after the guide plate 30 is slidably accommodated in the first trench 11 of the body 10, the rail 32 is slidably housed in the second trench 12. The rail 32 has multiple teeth 33 and multiple cutouts 34 which are connected together, and each of the multiple teeth 33 is defined between any two adjacent of the multiple cutouts 34, such that the multiple teeth 33 and the multiple cutouts 34 individually correspond to and retain with the two projections 26 and the trough 27 of the drive block 20. The conducting element 31 has a channel 312 longitudinally formed thereof and configured to slidably house the engagement element 111 of the body 10, wherein the channel 312 has two raised portions 311 extending inwardly and located adjacent to a top of the channel 312 so as to abut against two sides of the engagement element 111 respectively.

The second adjustment unit B0 includes an adjuster 50, an operation cavity 51 defined in the adjuster 50, a first aperture 52 formed on a first end of the operation cavity 51, a connecting room 55 formed on a second end of the operation cavity 51, two stop segments 56 formed on two distal ends of two sides of the connecting room 55 individually. The adjuster 50 further has a second aperture 57 defined on a first side thereof, an indentation 59 arranged on a second side of the adjuster 50 opposite to the first side of the adjuster 50, a third aperture 54 defined on the adjuster 50 such that a fixing element 73 inserts through the third aperture 54 so as to connect with a second connection portion 71 of an adjustment cover 70 which is coupled on the adjuster 50. The adjuster 50 has multiple fourth apertures 53 formed thereof respectively. The adjustment cover 70 has multiple affix portions 72 corresponding to the multiple fourth apertures 53, multiple lock elements 74 connected on the chair back X1 via the multiple affix portions 72 and the multiple fourth apertures 53 individually. An actuation unit 60 is slidably housed in the operation cavity 51 of the adjuster 50, wherein the actuation unit 60 includes an actuating element 61, two resilient elements 66, a band 68, and a pull ring 67, wherein the actuating element 61 has a recessed segment 65 defined on a first end thereof and slidably limited by two stop segments 56 of the adjuster 50, two positioning columns 64 respectively extending from two sides of the recessed segment 65 and configured to fit with the two resilient elements 66 respectively, hence the two resilient elements 66 are accommodated in the connecting room 55 of the adjuster 50. The actuating element 61 has a notch 63 corresponding to the second aperture 57 and the indentation 59 of the adjuster 50, and a fifth aperture 62 defined on a second end of the actuating element 61. The band 68 has a third connection portion 681 corresponding to the actuating element 61, a joining element 69 arranged on the third connection portion 681 and connected with a first end of the band 68, and the pull ring 67 is connected with a second end of the band 68, hence the pull ring 67 is pulled to drive the band 68, and the band 68 actuates the joining element 69 to drive the actuating element 61 to move.

The transmission cable Z0 includes a first transmitting segment Z1 and a second transmitting segment Z3 which are defined on two ends of the transmission cable Z0 respectively, wherein the first transmitting segment Z1 has a first defining portion Z2 formed on a distal end thereof, and the second transmitting segment Z3 has a second defining portion Z4 defined on a distal end thereof, wherein the first transmitting segment Z1 is fixed in the second aperture 57 of the adjuster 50, the notch 63 of the actuating element 61, and a dent 58 of the adjuster 50 so that the first defining portion Z2 of the distal end of the first transmitting segment Z1 is limited in the indentation 59 of the adjuster 50. The second transmitting segment Z3 is fixed in the second conduct recess 144 and the first conduct recess 146 of the body 10 and the slit 22 of the drive block 20 so that the second defining portion Z4 of the distal end of the second transmitting segment Z3 is limited in the locking space 21 of the drive block 20.

Referring to FIGS. 6-11, as desiring to lift the chair back X1, the pull ring 67 of the second adjustment unit B0 is pulled so that the notch 63 of the actuating element 61 pulls the first transmitting segment Z1 of the transmission cable Z0, and the drive block 20 of the first adjustment unit A0 is pulled by the second transmitting segment Z3 so that the trough 27 and the two projections 26 of the drive block 20 remove from the multiple teeth 33 and the multiple cutouts 34 of the rail 32 individually, and user manually pulls the chair back X1 to move longitudinally relative to the guide plate 30. After adjusting the chair back X1 to a desired position, the pull ring 67 is released so that the two resilient elements 66 push the actuating element 61 to move back to an original position, and the drive bock 20 is pushed by the two resilient elements 28 to urge the trough 27 and the two projections 26 to engage with the multiple teeth 33 and the multiple cutouts 34 respectively, and the chair back X1, the seat X2 and the guide plate 30 are positioned, thus adjustably lifting the chair back X1.

Figure 12:
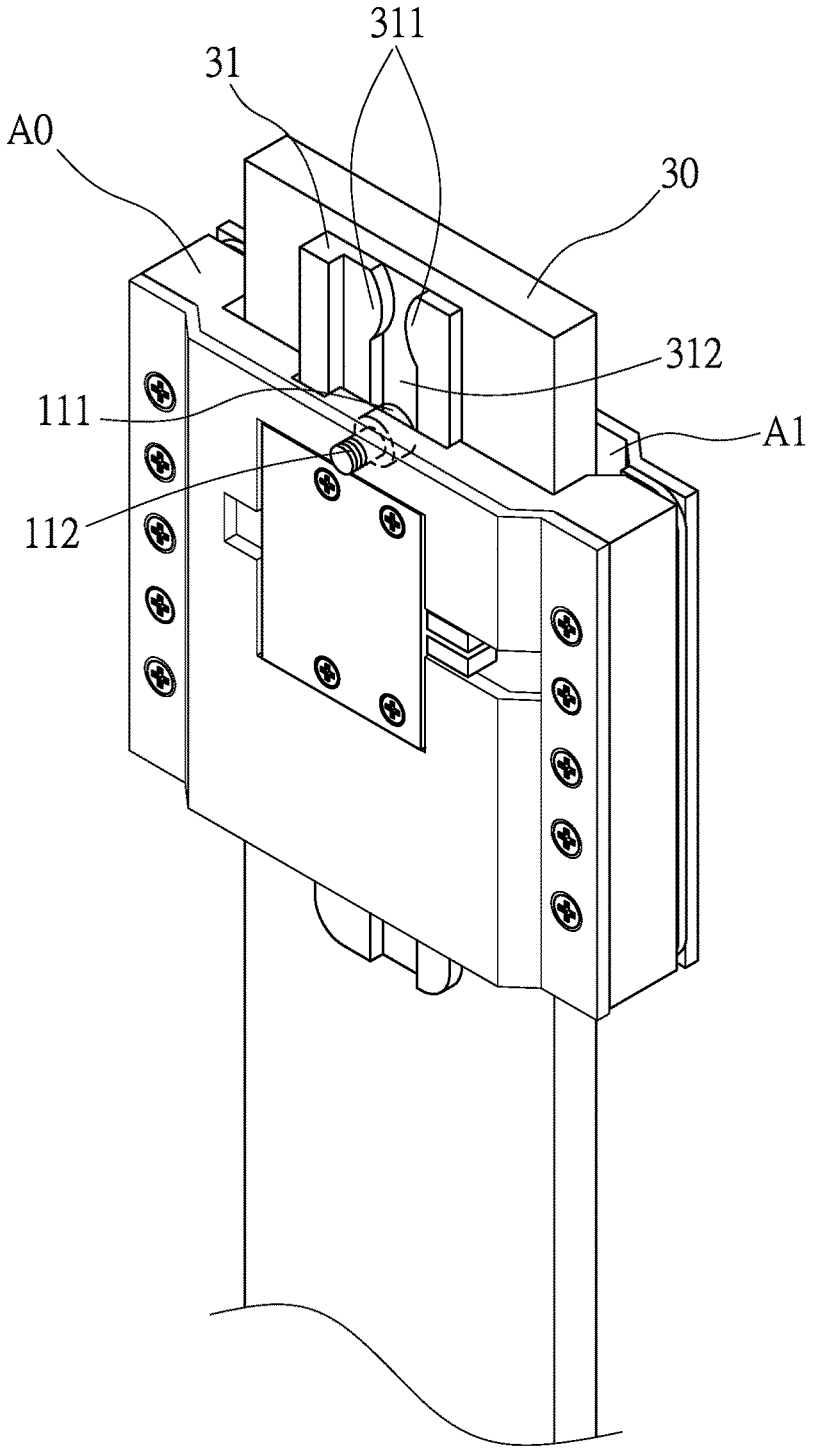
FIG. 12 is a perspective view showing the assembly of the first adjustment unit and a guide plate of the adjustable lifting structure for the chair back according to the preferred embodiment of the present invention.
Figure 13:
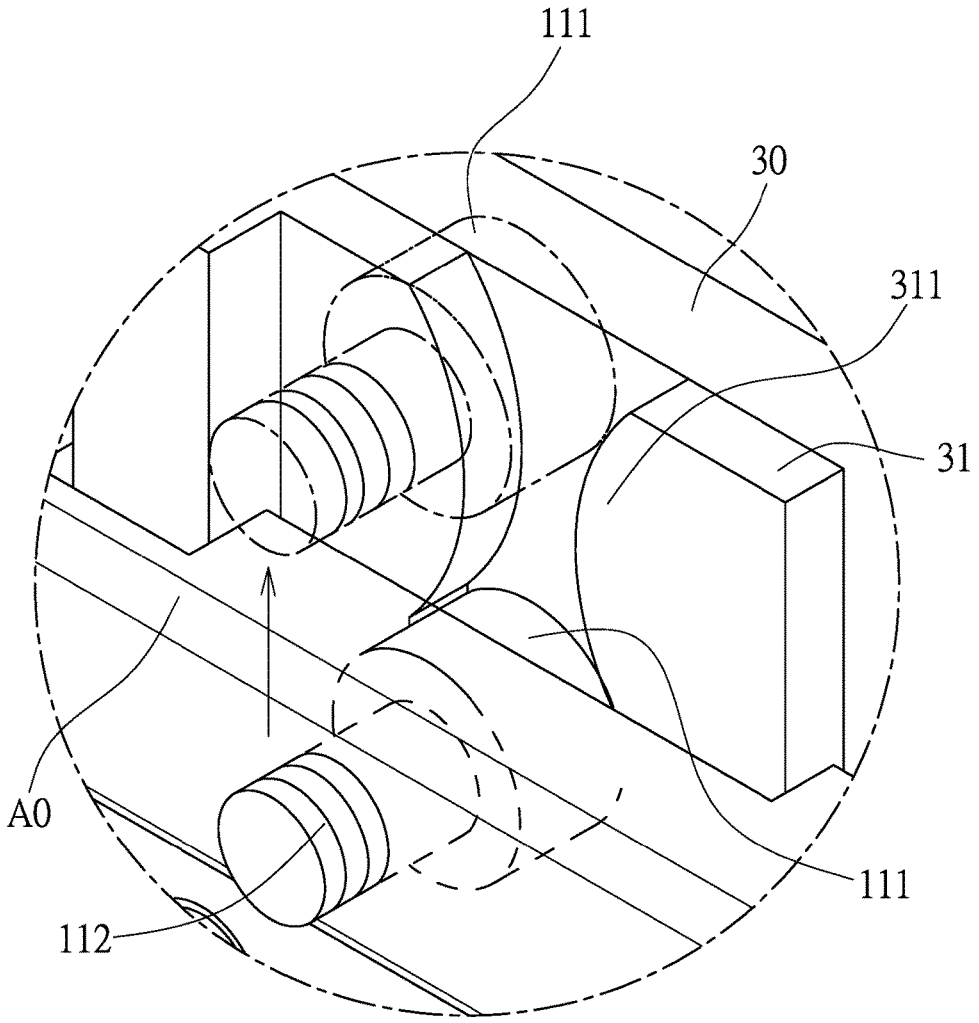
FIG. 13 is a perspective view showing the operation of the first adjustment unit and the guide plate of the adjustable lifting structure for the chair back according to the preferred embodiment of the present invention.
Figure 14:
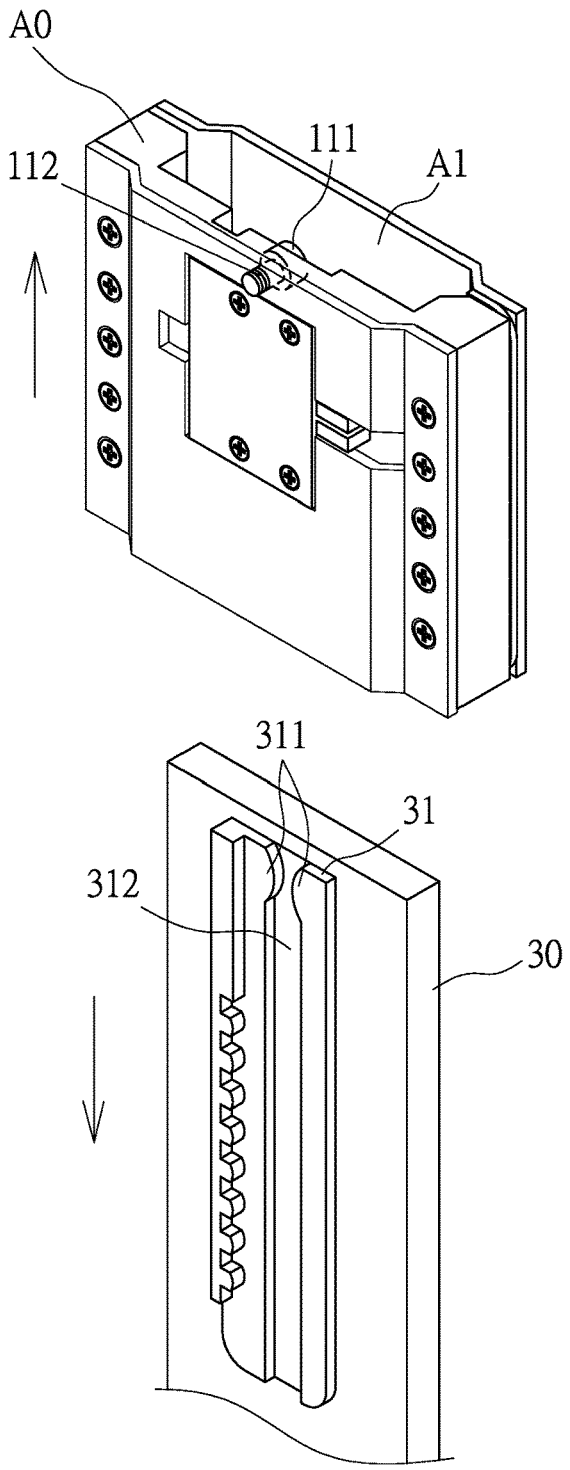
FIG. 14 is a perspective view showing the exploded components of the first adjustment unit and the guide plate of the adjustable lifting structure for the chair back according to the preferred embodiment of the present invention.

As illustrated in FIGS. 12-14, as desiring to remove the guide plate 30 from the longitudinally hollow chamber A1 of the first adjustment unit A0, the engagement element 111 is pulled upward so as to move across and being against the two raised portions 311, hence the guide plate 30 removes from the longitudinally hollow chamber A1 of the first adjustment unit A0 so as to store the guide plate 30 and the first adjustment unit A0.

While various embodiments in accordance with the present invention have been shown and described, it is clear to those skilled in the art that further embodiments may be made without departing from the scope of the present invention.

What is claimed is:

1. An adjustable lifting structure for a chair back comprising: a first adjustment unit and a second adjustment unit, wherein the first adjustment unit mates with the second adjustment unit via a transmission cable, wherein the first adjustment unit includes a longitudinally hollow chamber formed therein vertically and configured to slidably accommodate a guide plate, wherein a bottom of the guide plate is connected on a seat, wherein the first adjustment unit is disposed on a rear surface of the chair back, and wherein the second adjustment unit is fixed on the rear surface of the chair back; wherein:

the first adjustment unit includes a body, a covering assembly connected on a front end and a rear end of the body respectively so that the longitudinally hollow chamber is defined among the body and the covering assembly, and the body has a protrusion arranged on the front end of the body, a receiving groove formed in the protrusion and having a guiding recess defined on a first end of the receiving groove, a limiting segment arranged on a second end of the receiving groove, a slide recess extending from a center of the limiting segment, two flexible spaces formed on two sides of the slide recess individually, a first conduct recess defined on a distal end of the slide recess, and a second conduct recess extending from an end of the first conduct recess;

the body further includes multiple first connection portions and a first coupling orifice which are formed on two sides of the body respectively, wherein the multiple first connection portions and the first coupling orifice are configured to connect with the covering assembly, and the body includes multiple second coupling orifices defined thereof and configured to fix the body on the chair back; the body includes a first trench defined on the rear end thereof and includes a second trench longitudinally formed on the body, wherein the first trench has an engagement element mounted thereof adjacent to a top of the first trench, and the engagement element has a screwing portion defined on an end thereof so as to screw on the body;

a drive block includes a locking space defined on a front surface thereof, a slit extending from an end of the locking space, two deformable chambers defined on two sides of the locking space respectively, a driving segment formed on a first end of the drive block, a retainer formed on a rear surface of the drive block, a trough defined on a center of a side of the retainer, and two projections formed on two sides of the trough respectively; wherein the retainer is accommodated in the receiving groove of the body so that the locking space and the two deformable chambers are defined forwardly, the retainer is formed rearwardly, and the trough and the two projections are in the second trench of the body;

the guide plate includes a conducting element arranged on a surface thereof, a rail defined on a side of the conducting element so that after the guide plate is slidably accommodated in the first trench of the body, the rail is slidably housed in the second trench; the rail has multiple teeth and multiple cutouts which are connected together, and each of the multiple teeth is defined between any two adjacent of the multiple cutouts, such that the multiple teeth and the multiple cutouts individually engage and retain with the two projections and the trough of the drive block; the conducting element has a channel longitudinally formed thereof and configured to slidably house the engagement element of the body, wherein the channel has two raised portions extending inwardly and located adjacent to a top of the channel so as to abut against two sides of the engagement element respectively;

the second adjustment unit includes an adjuster, an operation cavity defined in the adjuster, a first aperture formed on a first end of the operation cavity, a connecting room formed on a second end of the operation cavity, two stop segments formed on two distal ends of two walls in the connecting room individually; the adjuster further has a second aperture defined on a first side thereof, an indentation arranged on a second side of the adjuster opposite to the first side of the adjuster, a third aperture defined on the adjuster such that a fixing element inserts through the third aperture so as to connect with a second connection portion of an adjustment cover which is coupled to the adjuster; the adjuster has multiple fourth apertures formed thereof respectively, the adjustment cover has multiple affix portions comprising the multiple fourth apertures, multiple lock elements connected on the chair back via the multiple affix portions and the multiple fourth apertures individually; an actuation unit is slidably housed in the operation cavity of the adjuster, wherein the actuation unit includes an actuating element, two resilient elements, a band, and a pull ring, wherein the actuating element has a recessed segment defined on a first end thereof and slidably limited by the two stop segments of the adjuster, two positioning columns respectively extending from two sides of the recessed segment and configured to fit with the two resilient elements respectively, hence the two resilient elements are accommodated in the connecting room of the adjuster; the actuating element has a notch in general alignment with the second aperture and the indentation of the adjuster, and a fifth aperture defined on a second end of the actuating element; the band has a third connection portion connected to the actuating element, a joining element arranged on the third connection portion and connected with a first end of the band, and the pull ring is connected with a second end of the band, hence the pull ring is pulled to drive the band, and the band actuates the joining element to drive the actuating element to move; and a transmission cable includes a first transmitting segment and a second transmitting segment which are defined on two ends of the transmission cable respectively, wherein the first transmitting segment has a first defining portion formed on a distal end thereof, and the second transmitting segment has a second defining portion defined on a distal end thereof, wherein the first transmitting segment is fixed in the second aperture of the adjuster, the notch of the actuating element, and a dent of the adjuster so that the first defining portion of the distal end of the first transmitting segment is limited in the indentation of the adjuster; the second transmitting segment is fixed in the second conduct recess and the first conduct recess of the body and the slit of the drive block so that the second defining portion of the distal end of the second transmitting segment is limited in the locking space of the drive block.

2. The adjustable lifting structure as claimed in claim 1, wherein the covering assembly includes a first lid, a second lid, two washers, and a cap, wherein the first lid has a first hole corresponding in position to the protrusion of the body, a second hole corresponding in position to the first coupling orifice of the body, and a first screw bolt configured to screw with the second hole and the first coupling orifice, the cap has multiple third holes defined thereof respectively, and the body includes multiple third coupling orifices corresponding in position to the multiple third holes individually, a second screw bolt inserts through each of the multiple third coupling orifices and each of the multiple third holes so as to screw the cap with the protrusion; the second lid has multiple fourth holes, and the two washers have two fifth holes corresponding in position to the multiple fourth holes individually, a third screw bolt inserts through each of the two fifth holes and each of the multiple fourth holes so as to screw with each of the multiple first connection portions of the body.

* * * * *